United States Patent [19]

Wieland

[11] Patent Number: 4,833,989

[45] Date of Patent: May 30, 1989

[54] AXIALLY SHIFTABLE SHEET GRIPPER ASSEMBLY

[75] Inventor: Erich G. Wieland, Würzburg, Fed. Rep. of Germany

[73] Assignee: Koenig & Bauer Aktiengesellschaft, Würzburg, Fed. Rep. of Germany

[21] Appl. No.: 131,460

[22] Filed: Dec. 11, 1987

[30] Foreign Application Priority Data

Dec. 24, 1986 [DE] Fed. Rep. of Germany ..... 3644431

[51] Int. Cl.[4] ..... B41F 21/04

[52] U.S. Cl. ..... 101/410; 101/246; 271/82; 271/252; 271/286

[58] Field of Search ..... 101/409, 410, 415.1, 101/246; 271/82, 252, 285, 286

[56] References Cited

U.S. PATENT DOCUMENTS

| | | | |
|---|---|---|---|
| 2,553,758 | 5/1951 | Gegenheimer | 271/252 |
| 2,986,394 | 5/1961 | Seieke | 271/252 |
| 3,125,022 | 3/1964 | Reindity et al. | 101/410 X |
| 3,534,683 | 10/1970 | Barthel | 101/410 X |
| 3,985,074 | 10/1976 | Bonseh | 101/410 |
| 4,588,184 | 5/1986 | Jeschke | 271/252 X |
| 4,657,240 | 4/1987 | Bollinger | 271/253 X |
| 4,702,469 | 10/1987 | Jeschke et al. | 271/252 X |

FOREIGN PATENT DOCUMENTS

| | | | |
|---|---|---|---|
| 2154612 | 5/1973 | Fed. Rep. of Germany | 101/410 |
| 1934029 | 7/1978 | Fed. Rep. of Germany | 101/410 |
| 2808528 | 10/1980 | Fed. Rep. of Germany | 101/410 |
| 2913410 | 3/1981 | Fed. Rep. of Germany | 101/410 |
| 424749 | 10/1979 | U.S.S.R. | 101/410 |
| 341280 | 1/1931 | United Kingdom | 101/410 |
| 2093438 | 9/1982 | United Kingdom | 101/410 |

*Primary Examiner*—Edgar S. Burr
*Assistant Examiner*—James R. McDaniel
*Attorney, Agent, or Firm*—Jones, Tullar & Cooper

[57] ABSTRACT

An axially shiftable sheet gripper assembly includes cooperating gripper fingers and gripper abutment surfaces mounted on an axially slidable carriage. The carriage is located in a groove in a sheet transfer drum and carries a control roller at one end. The control roller rides on a control surface of a pivotable control disk. This control disk is movable toward and away from a side face of the sheet transfer drum to regulate the axial movement of the sheet transfer mechanism carriage.

6 Claims, 4 Drawing Sheets

AXIALLY SHIFTABLE SHEET GRIPPER ASSEMBLY

FIELD OF THE INVENTION

The present invention is directed generally to an axially shiftable sheet gripper assembly. More particularly, the present invention is directed to an axially shiftable sheet gripper assembly in a transfer cylinder. Most specifically, the present invention is directed to an axially shiftable sheet gripper assembly in a transfer cylinder of a rotary printing machine. The axially shiftable sheet gripper assembly is carried in an axially extending groove in a sheet transfer drum and its axial shifting or movement is caused by the cooperation of a control roller and a control disk. This control disk is pivotably attached to a side frame of the rotary printing machine and is movable toward and away from the sheet transfer drum. Sheet pick up and transfer after axial shifting are accomplished at points where there is no axial movement of the axially shiftable sheet gripper assembly.

DESCRIPTION OF THE PRIOR ART

The general concept of provision of a mechanism for axially shifting a sheet gripper assembly in a groove provided in a transfer drum is known in the art. German patent No. 2,808,528 discloses an apparatus for accomplishing such an axial shifting of a sheet gripper assembly. This patent uses a cam body having a control shape or contour which is used to provide an axial shifting of the gripper assembly. This cam body is secured to one end of a control lever and cooperates with a roller carried at a first end of the axially shiftable sheet gripper assembly. A control lever joins the contoured cam body to a control roller. This control roller rides on the periphery of a stationary control disk. During each revolution of the transfer cylinder, the axially shiftable sheet gripper assembly moves or is shifted completely to the right, from there completely to the left, and then back into a position in which sheet transfer takes place. The stationary control disk on which the control roller rides can be shifted either in the circumferential direction of rotation of the transfer drum or alternatively in a circumferential direction opposite to the rotation of the sheet transfer drum. Thus the rotational point of a particular phase of axial shifting of the sheet transfer gripper assembly can be controlled but not the overall magnitude of the axial shifting.

This prior art axially shiftable sheet gripper assembly shown in German Pat. No. 2,808,528 is constantly moved axially back and forth to the maximum limits of the travel. While the phase of shifting with respect to the circumferential position of the sheet transfer drum can be varied by changing the position of the stationary control disk, the magnitude of the axial shifting of the sheet gripper assembly cannot be varied. Furthermore, sheet transfer of a shifted sheet does not occur on a dead center or cusp point of the sheet gripper assembly relative to its axial shift speed. This means that a sheet is not able to be transferred in an absolutely stationary state after having undergone axial movement.

It will thus be seen that a need exists for an axially shiftable sheet gripper assembly in which the magnitude of the axial shifting is controllable and further in which the sheet being transferred can do so at a point in which there is no axial movement of the sheet gripper assembly at the time of transfer. The axially shiftable sheet gripper assembly of the present invention provides such a device.

SUMMARY OF THE INVENTION

It is an object of the present invention to provide an axially shiftable sheet gripper assembly.

Another object of the present invention is to provide an axially shiftable sheet gripper assembly for a sheet transfer drum.

A further object of the present invention is to provide an axially shiftable sheet gripper assembly for a sheet transfer drum in a rotary printing machine.

Yet another object of the present invention is to provide an axially shiftable sheet gripper assembly in which the magnitude of axial travel of the sheet gripper assembly is controllable.

Still a further object of the present invention is to provide an axially shiftable sheet gripper assembly in which sheet transfer is accomplished when there is not axial movement of the sheet being transferred.

As will be discussed in greater detail in the description of the preferred embodiment which is set forth subsequently, the axially shiftable sheet gripper assembly of the present invention includes a plurality of sheet gripper fingers and a cooperating gripper abutment surface unit which are all carried on a carriage. This carriage is axially shiftable in a groove on the surface of a sheet transfer drum or cylinder. A control roller is attached to one end of the shiftable carriage and rides on a face of a control disk. The control disk is pivotably attached to the side frame of the printing machine and is pivotable about a pivot axis. The circulation path of the control roller on the control disk intersects the pivot axis of the disk at a point where a sheet is handed over to the sheet transfer drum. This allows sheet hand over while the gripper assembly is not in axial motion. The control disk's amount of pivotal movement is controllable in accordance with the desired axial shifting of the sheet. Thus at sheet hand off, the axially shiftable carriage has moved to its desired shifted position so that sheet hand off is accomplished at a dead center or cusp point in which the sheet gripper assembly is not being axially shifted.

In the axially shiftable sheet gripper assembly of the present invention, the adjustable control disk can be properly positioned so that only the desired amount of axial shifting of the sheet gripper assembly is performed. Thus the shifting of the sheet gripper assembly and hence the sheet being transferred to the extreme shifted position is only necessary if it is desired that the sheet be shifted this much. In contrast with the prior art devices in which the sheet gripper assembly was shifted to its maximum limits during each drum revolution, the present assembly provides an adjustment of the axial shift distance so that only that amount of shift required by the cylinder to which the sheet is to be handled off to is accomplished.

The axially shiftable sheet gripper assembly of the present invention only has to shift the sheet and gripper assembly from its transfer position to its nominal position and back to the transfer position, as opposed to the prior art device which required shifting of each sheet and gripper assembly over the entire working range of the axially shiftable sheet gripper assembly. Additionally, the times of take over and hand over of each sheet can be accomplished when the sheet gripper assembly is axially stationary. Furthermore, it is possible that, as soon as the sheet has been transferred to the following cylinder, to start returning the sheet gripper assembly back to its starting position. This means that on a sheet transfer drum which carries only one sheet gripper assembly that the entire time required for one revolution of the drum is available for adjusting the control disk or cam into a nominal position, since the position of the cusp point for the sheet transfer onto the cylinder and the position of the axially shiftable sheet gripper assembly cannot be influenced by the position of the cam.

It will thus be seen that the axially shiftable sheet gripper assembly of the present invention provides a sheet shifting device which is far superior to prior art devices.

BRIEF DESCRIPTION OF THE DRAWINGS

While the novel features of the axially shiftable sheet gripper assembly in accordance with the present invention are set forth with particularity in the appended claims, a full and complete understanding of the invention may be had by referring to the detailed description of a preferred embodiment as is set forth hereinafter and as is illustrated in the accompanying drawings in which:

DESCRIPTION OF THE PREFERRED EMBODIMENT

Figure 1:
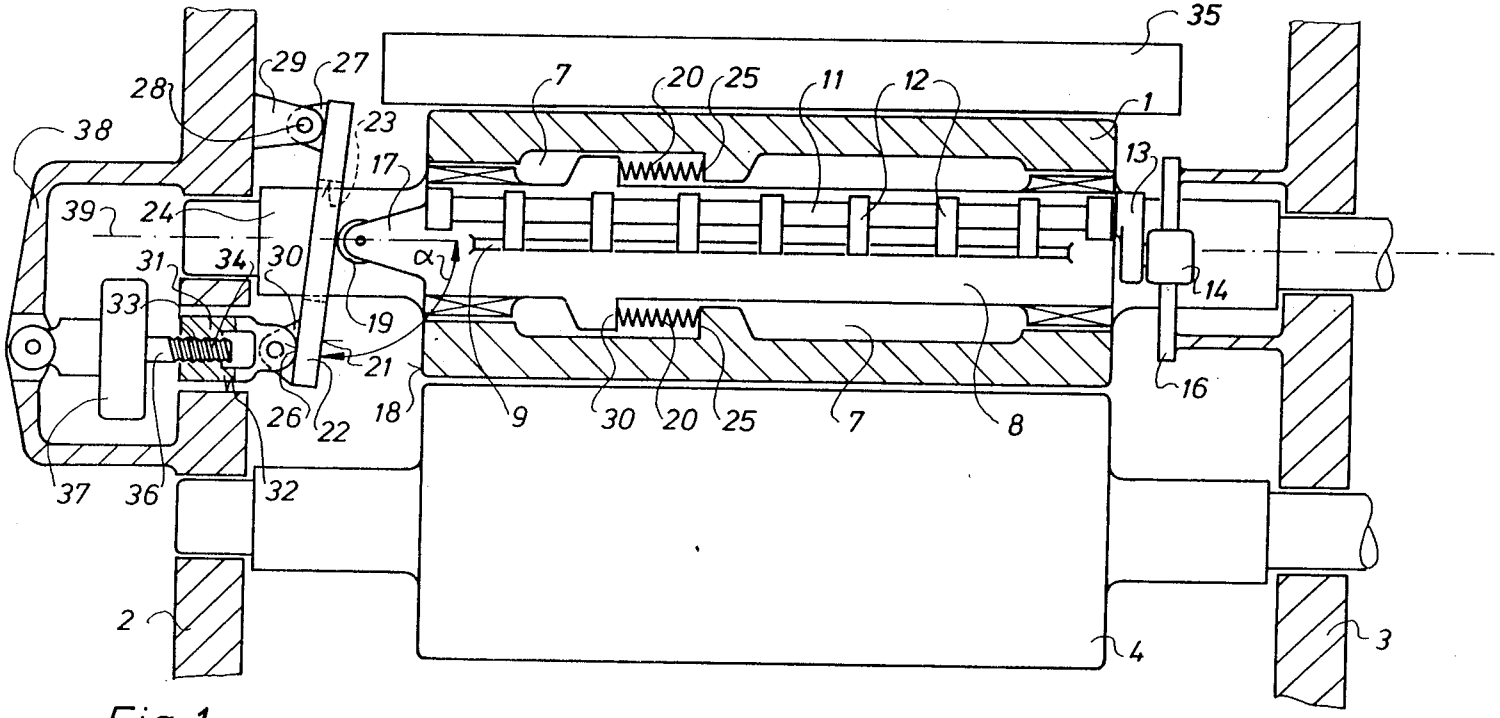
FIG. 1 is a top plan view of the axially shiftable sheet transfer drum assembly in accordance with the present invention with portions thereof shown in cross section.

Referring initially to FIG. 1, there may be seen a sheet transfer drum 1 which is supported in a generally known manner between side frames 2 and 3 of a rotary printing machine. A sheet receiving cylinder 4 is likewise supported by the side frames 2 and 3. This cylinder 4 receives sheets from the sheet transfer drum 1 and these sheets, which are to be transferred to sheet receiving cylinder 4, are to be shifted axially so that they will be handed over to cylinder 4 with their side edges correctly positioned in accordance with a desired position dictated by downline printing requirements.

Figure 2:
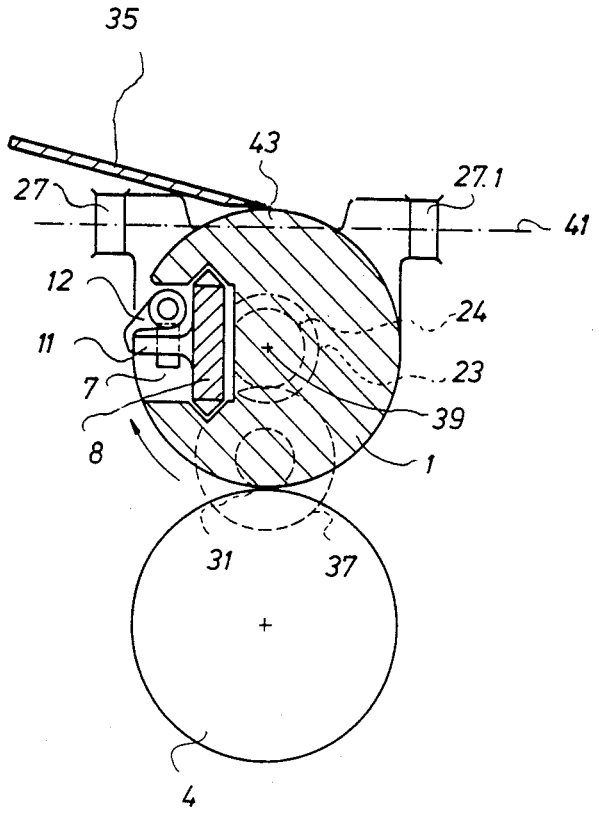
FIG. 2 is a cross-sectional side elevation view of the sheet transfer drum of the present invention.
Figure 4:
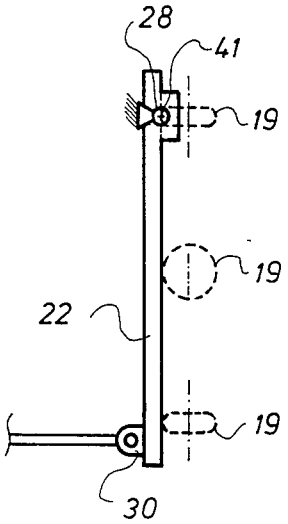
FIG. 4 is a side view of the control disk shown in FIG. 3.

As may be seen in FIGS. 1 and 2, sheet transfer drum 1 has a groove 7 formed adjacent is periphery. Groove 7 is parallel to the rotational axis 39 of drum 1 and includes guide pieces for an axially shiftable carriage 8. Carriage 8 carries a gripper abutment surface rail 9 and a controllable gripper control spindle 11, on which a plurality of gripper fingers 12 are fastened. For control of the gripper control spindle 11, there is provided a roller lever 13 which carries a roller 14 that rotates on a cam 16 fastened to the side frame 3. The sheet gripper carriage 8 protrudes with a left end portion 17 extending beyond a side face 18 of the sheet transfer drum 1. A control roller 19 is mounted for rotation on the left end extension 17 of sheet gripper carriage 8. This control roller is in rolling contact with, and rolls on a right side face 21 of a control disk or cam 22. As may be seen in FIG. 1, the right side face 21 of disk 22 is that face which is closest to the carriage 8. The control roller 19 is pressed towards the side face 21 through the force of one or more pressure springs 20 which have their counter bearing on a heel 25 of the drum body of the sheet transfer drum 1 and their point of force application on the carriage 8. In this way it is insured that the control roller 19 will remain in constant physical contact with the disk 22.

As may be seen in FIGS. 1 and 2, control disk 22 has a borehole 23 in its middle through which a left shaft end 24 of a sheet transfer drum 1 protrudes. On a left side face 26 of disk 22, which faces the side frame 2, two butt straps 27 and 27.1 are fastened on an upper part while one butt strap 30 is fastened on a lower part of left surface 26 of disk 22. The disk 22 is thus pivotably arranged by means of its butt straps 27 and 27.1 about mountings 29 and 29.1. Disk 22 is joint-connected by means of its butt strap 30 with a horizontally shiftable bell-shaped adjustment element 31 that has an interiorly threaded socket 33. The bell-shaped adjustment element 31 is, in turn supported in a borehole 32 in side frame 2. A threaded pin 34 is secured to a first end of a reduction shaft 36 and is received in the interiorly threaded socket 33 of bell-shaped adjustment element 31. Reduction shaft 36 is caused to rotate by an adjustment drive motor 37 which may, for example be a stepper motor or a servo motor. The adjustment drive motor 37 is fastened to a side support 38 which is rigidly connected to the side frame 2. With one turn of the reduction shaft 36 in a clockwise or counterclockwise direction, the threaded pin 34 is caused to be screwed into or out of the internally threaded socket 33, causing the bell-shaped adjustment element 31 to be shifted horizontally to either the left or to the right and the disk 22, depending on the turning direction of the threaded pin 34, to be pivoted either towards the side face 18 of the drum 1 or away from it.

Figure 3:
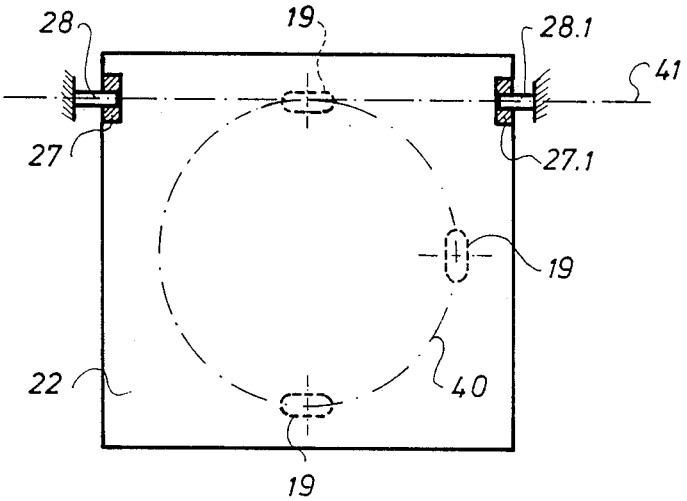
FIG. 3 is a schematic view of the control disk and showing the control roller circular path.

As may be seen most clearly in FIG. 3 control disk 22 has upper left and right journals 28 and 28.1 which are supported in their respective butt straps 27 and 27.1. As is also shown in FIG. 3 a pivot axis line 41 of the disk 22 is located in right side face 21 which serves as a control face. Moreover, the rotation cam radius 40 of the control roller 19 is chosen such that at the point of takeover of a sheet from another drum or sheet feed plate 35, the circulation path 40 of the control roller 19 and the pivot axis line 41 touch. In this way it is possible for a first dead point or cusp in the circulation of the control roller 19 to be created which, even with a large pivot action of the disk 22, does not shift. Also, this relation of pivot axis line 41 to circulation path 40 enables the disk 22 to be pivoted into its new position before the sheet which is just about to be aligned is taken over by the sheet transfer mechanism 8.

Sheet transfer to sheet transfer drum 1 from sheet feed plate 35 always takes place when control roller 19 is on pivot axis 41 of control disk 22. Since control disk 22 does not move at this pivot axis line 41, regardless of the amount of movement of the lower portion of disk 22, there will be no axial movement of sheet transfer mechanism carriage 8 at this point. Thus sheets are taken on by the sheet gripper assembly while it is at a dead or rest point. In a generally similar manner, while the side face 21 of disk 22 and the rotational axis 39 of sheet transfer drum 1 form various pivoting angles $\alpha$ during movement of disk 22 and hence of carriage 8, the position of disk 22 is controlled so that it is at a maximum pivot angle $\alpha$ when the sheet is handed off from sheet transfer drum 1 to the sheet receiving cylinder 4.

This means that as the sheet is being handed over to the receiving cylinder 4, the axially movable carriage 8 has reached the limit of its axial travel. Thus sheet hand over is again accomplished while the sheet is axially stationary and is not moving with respect to the sheet transfer drum 1. Hence in marked contrast with the prior art axially shiftable sheet gripper assemblies, in which the control cam had one profile which caused the axial shifting of the gripper assembly to its maximum end points and in which sheet shifts of less than the maximum value were accomplished by repositioning the control cam and by sheet transfers in which the sheet had an axial component of movement during transfer, the sheet transfer assembly of the present invention provides for inclining the control disk 22 at an inclination angle $\alpha$ sufficient to axially shift the sheet the desired nominal amount while not requiring the axially movable carriage to travel to its extreme end position for each rotation of the sheet transfer drum 1. Since the axially movable sheet gripper carrying carriage moves only to the extent caused by the pivotable control disk 22, once the sheet gripper fingers 12 have released the sheet to the subsequent cylinder 4, the carriage 8 can start to return to its sheet take over position. This allows more time for the carriage to return to its starting position than was provided by the prior art devices.

Figure 5:
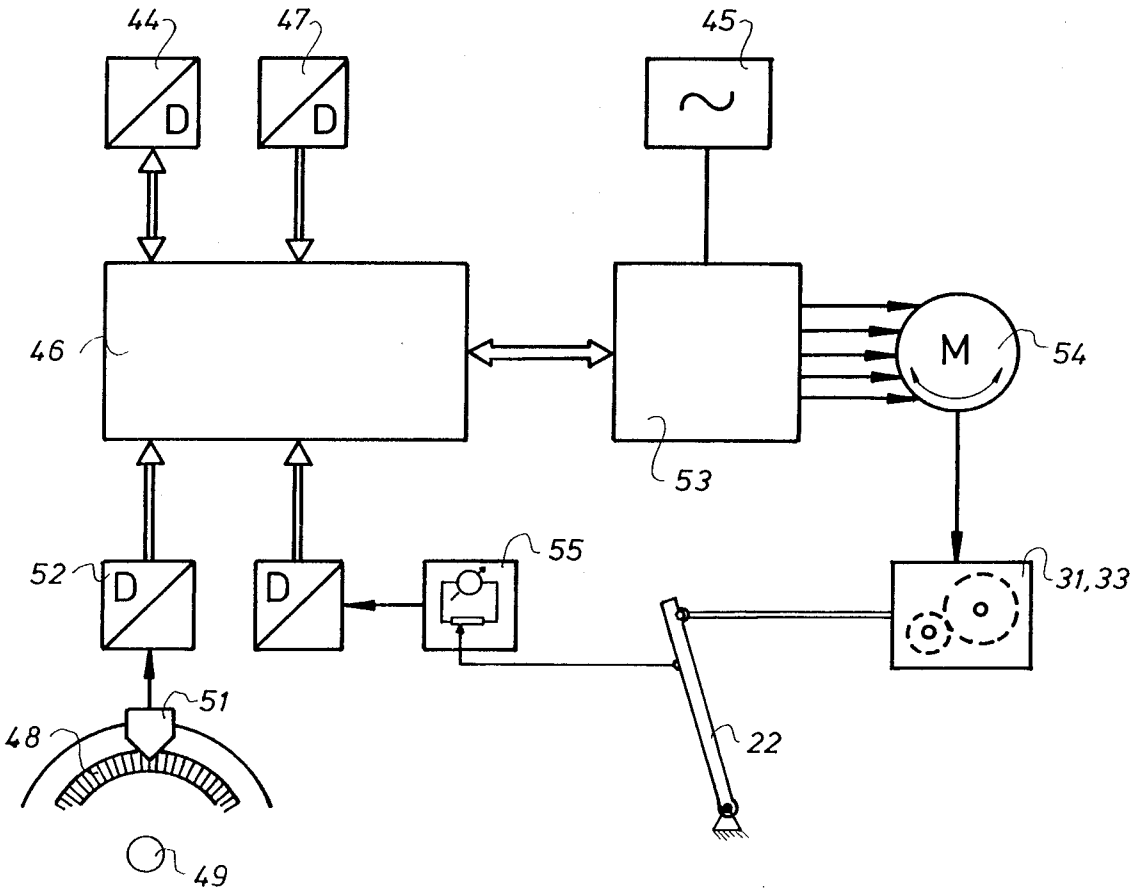
FIG. 5 is a block circuit diagram of a control arrangement for the axially shiftable sheet gripper assembly of the present invention.

Turning now to FIG. 5, there may be seen an arrangement for controlling the pivotal motion of control disk 22 in an automatic manner. By means of a measuring head 44 as, for example, is shown in German unexamined patent application No. 29 13 410, the actual position of the sheet side edge is measured at a determined point of time. This actual measured value is converted into digital pulses in the measuring head 44 and these pulses are fed to a programmed microprocessor 46. From an adjustable, digital nominal value emitter 47, digital nominal value pulses are also passed on to the microprocessor 46. The nominal side edge position of the sheet to be aligned at the point of time of hand-over from the sheet transfer drum 1 to the following cylinder 4 is set forth by the adjustable nominal value emitter 47.

A pulse disk 48, which is driven by a so-called one revolution shaft 49, a digital rotational pulse emitter 51, and a pulse amplifier 52, which passes on the digital pulses to the microprocessor 46 are used to divide up the 360° through which the one revolution shaft 49 turns per sheet, into, for example, 30,000 pulses. The microprocessor 46 can now be programmed so that, for example, at the xth pulse the actual sheet position measured value is taken from the measuring head 44, at the yth pulse the microprocessor 46 begins to pass on defined control pulses to a control circuit 53 with an end step for controlling the stepper motor 54 which positions disk 22, and at the zth pulse an inquiry takes place whether the disk 22 has reached the nominal or sheet release position. The recording of the actual position of the disk 22 may be undertaken, for example, by means of a digital path measuring device 55, which is secured to the disk 22 and to the machine frame, as is shown schematically in FIG. 5.

If the measuring head 44 measures a deviation from the desired side edge position of the sheet, as provided by the nominal value emitter 47, then the microprocessor 46 passes on such pulses to the control circuit 53 so that this brings the disk 22 via the adjustment motor 54 into a position in which the sheet transfer mechanism 8 is, at the latest by the point of time of transfer of the sheet from the sheet transfer drum 1 to the following cylinder 4, placed in a position which exactly corresponds to the nominal side edge position of the sheet. By means of the path measuring device 55, the actual position of the disk 22 is checked. If the desired nominal position and the actual position of disk 22 are not equal shortly before sheet transfer, then the microprocessor 46 decides whether the deviation may still reach the nominal value, or whether it gives a command such as "Impression off". "Waste copy ON" or "Machine Stop" to the machine control.

Once the actual position of the disk 22 and with it the final side edge position of the sheet on the sheet transfer drum 1 is reached, then this value is stored in the microprocessor 46 and is compared with the desired nominal position of the disk 22 for the next sheet. From the position for the preceding sheet, the disk 22 is, each time, brought directly into the position for the following sheet. It is therefore not necessary ever to go from an extreme position into the nominal position.

While a preferred embodiment of an axially shiftable sheet gripper assembly in accordance with the present invention has been set forth fully and completely hereinabove, it will be apparent to one of skill in the art that a number of changes in, for example the particular structure of the sheet gripper fingers and abutment surface, the number of axially slidable carriages on the sheet transfer drum, the specific adjustment drive motor and the like may be made without departing from the true sprit and scope of the invention which is accordingly to be limited only by the following claims.

What is claimed is:

1. An axially shiftable sheet gripper assembly for a sheet transfer drum of a sheet fed rotary printing machine, said sheet gripper assembly comprising:

a plurality of sheet gripper fingers carried on a controllable sheet gripper shaft and engageable with a sheet gripper abutment surface;

an axially shiftable sheet gripper carriage on which said sheet gripper shaft and said sheet gripper abutment surface are arranged, said axially shiftable sheet gripper carriage being shiftable axially in a groove in said sheet transfer drum, said groove extending generally parallel to an axis of rotation of said sheet transfer drum; and means for effecting said axial shifting of said carriage in said groove, said means including a control disk having a portion secured to a fixed pivot axis which lies on a side face of said control disk facing a side surface of said sheet transfer drum and having a free portion which is pivotable about said fixed pivot axis toward and away from said side surface of said sheet transfer drum, said means further including a control roller carried on said axially shiftable sheet gripper carriage, said control roller being in rolling contact with said side face of said control disk whereby pivoting of said control disk about said fixed pivot axis moves said side face of said control disk toward and away from said side surface of said sheet transfer drum to effect said axial shifting of said sheet gripper carriage in said groove.

2. The axially shiftable sheet gripper assembly of claim 1 wherein a circulation path of said control roller on said side face of said control disk and said pivot axis intersect at a first dead point.

3. The axially shiftable sheet gripper assembly of claim 2 wherein said sheet gripper fingers are opened to receive a sheet on said sheet transfer drum at said first dead point.

4. The axially shiftable sheet gripper assembly of claim 1 wherein a stepper motor is provided to pivot said control disk.

5. The axially shiftable sheet gripper assembly of claim 1 wherein a servo motor is provided to pivot said control disk.

6. The axially shiftable sheet gripper assembly of claim 4 wherein a rotatable threaded pin is rotated by said stepper motor and causes said control disk to pivot.

* * * * *